United States Patent [19]

Kawamura et al.

[11] Patent Number: 4,636,335

[45] Date of Patent: Jan. 13, 1987

[54] METHOD OF DISPOSING RADIOACTIVE ION EXCHANGE RESIN

[75] Inventors: Fumio Kawamura; Masami Matsuda; Yoshiyuki Aoyama; Koichi Chino; Mamoru Mizumoto, all of Hitachi, Japan

[73] Assignee: Hitachi, Ltd., Tokyo, Japan

[21] Appl. No.: 559,084

[22] Filed: Dec. 7, 1983

[30] Foreign Application Priority Data

Dec. 10, 1982 [JP] Japan ..... 57-215577

[51] Int. Cl.[4] ..... G21F 9/16; G21F 9/32

[52] U.S. Cl. ..... 252/629; 110/237; 110/342; 110/346; 110/344; 159/DIG. 12; 252/626; 252/632

[58] Field of Search ..... 252/626, 631, 632, 628, 252/629; 159/47.3, DIG. 12; 110/237, 342, 238, 346

[56] References Cited

U.S. PATENT DOCUMENTS

| | | | |
|---|---|---|---|
| 2,616,847 | 11/1952 | Ginell | 252/626 |
| 4,053,432 | 10/1977 | Tiepel et al. | 252/632 |
| 4,139,488 | 2/1979 | Knotik et al. | 252/633 |
| 4,152,287 | 5/1979 | Bjorkland et al. | 252/626 |
| 4,235,738 | 11/1980 | Knotik et al. | 252/626 |
| 4,362,659 | 12/1982 | Macedo et al. | 252/629 |
| 4,437,999 | 3/1984 | Mayne | 252/626 |
| 4,460,500 | 7/1984 | Hultgren | 252/629 |
| 4,499,833 | 2/1985 | Grantham | 252/632 |

FOREIGN PATENT DOCUMENTS

| | | | |
|---|---|---|---|
| 0043430 | 3/1980 | Japan | 252/626 |
| 0094199 | 7/1980 | Japan | 252/632 |
| 0001446 | 1/1982 | Japan | 252/626 |

*Primary Examiner*—Stephen J. Lechert, Jr.
*Assistant Examiner*—Howard J. Locker
*Attorney, Agent, or Firm*—Antonelli, Terry & Wands

[57] ABSTRACT

A method for processing spent radioactive ion exchange resin formed in a nuclear power plant by a two-step pyrolysis method. First, the spent resin is heated at 350° C. to decompose functional groups selectively. Then the base polymer, formed as residue, is decomposed at a temperature above 350° C., e.g. 600° C. After the thermal decomposition, exhaust gases which require a special exhaust gas disposal means, such as $NO_x$ and $SO_x$ can be reduce to below 1/20.

16 Claims, 4 Drawing Figures

METHOD OF DISPOSING RADIOACTIVE ION EXCHANGE RESIN

BACKGROUND OF THE INVENTION

This invention relates to a method for processing spent radioactive ion exchange resin formed in a nuclear power plant and particularly to a processing method whereby the volume of the waste resin is reduced while the waste resin is converted into stable inorganic compounds by thermal decomposition.

The operation of a nuclear power plant is accompanied with the formation of waste liquid containing a variety of radioactive substances, and these waste liquid are processed in most cases with ion exchange resin. The processing of spent resin produced thereby has been a problem of a nuclear power plant operation. For example, spent ion exchange resin accounts for a considerable portion of the radioactive wastes in a boiling water reactor power plant.

Heretofore, spent ion exchange resin is solidified in a drum by mixing it with a solidifying agent such as cement or asphalt, and stored and kept in the plant area. However, the volume of these radioactive wastes tends to increase year after year, so that the acquisition of their storage place and the security of safety during their storage have been important problems. Accordingly, a great concern has been paid about reducing the volume of spent waste resin as much as possible in solidifying it.

For example, processes for the volume reduction of radioactive waste ion exchange resin include those based on acid decomposition. One of them is a process called HEDL Process (Hanford Engineering Development Laboratory Process) comprising acid-decomposing the resin at a temperature of 150° to 300° C. by using concentrated sulfuric acid (about 97 wt. %) and nitric acid (about 60 wt. %). Another example is a process described in Japanese Patent Laid-Open No. 88500/1978, comprising acid-decomposing the resin by using concentrated sulfuric acid and hydrogen peroxide (about 30%). Although a high volume reduction ratio can be obtained in these acid decomposition processes because the resin is decomposed after dissolution and the decomposition solution is concentrated by evaporation, there are a number of difficult problems, such as handling of a strongly acidic solution, corrosion of equipment by a concentrated strongly acidic solution, and an unestablished technique of solidifying a recovered concentration solution.

Accordingly, Japanese Patent Laid-Open No. 1446/1982 proposed a process in which no strong acid is used and which comprises decomposing waste resin by using hydrogen peroxide in the presence of an iron catalyst. Since, however, this process requires a large quantity of hydrogen peroxide, there is a problem that the cost is high because of the expensiveness of hydrogen peroxide and, in addition, decomposition itself is not sufficient and organic matter remains undecomposed.

Still another process proposed in Japanese Patent Laid-Open No. 12400/1982 comprises burning waste resin by using a fluidized bed. However, this process has a problem that it generates a large quantity of exhaust gas which also must be subjected to appropriate disposal procedures.

SUMMARY OF THE INVENTION

It is an object of this invention to solve the above-described problems and to provide a method for processing spent radioactive waste resin by thermally decomposing the waste resin, whereby the volume of the waste resin is reduced and the exhaust gas generated during decomposition can be selectively disposed.

This invention proposes a method for processing spent radioactive ion exchange resin by thermal decomposition, wherein the ion exchange groups of the ion exchange resin are thermally decomposed at low temperatures and, thereafter, the polymer matrix of the ion exchange resin is thermally decomposed at high temperatures.

The process of this invention is based on the following knowledge and its fundamental principles will now be described.

An ion exchange resin is an aromatic organic polymer compound having a structure comprising a copolymer of styrene with divinylbenzene (D.V.B.) as a matrix to which are bonded ion exchange groups. These ion exchange groups are sulfonic acid groups for a cation exchange resin and quaternary ammonium groups for an anion exchange resin. In this invention, attention is paid to the fact that the bond energy between the ion exchange group and the matrix is extremely small as compared with that between the constituents of the resin matrix, and the ion exchange groups are thermally decomposed in the first stage separately from the resin matrix at low temperatures and, thereafter, the resin is thermally decomposed in the second stage at high temperatures; i.e., at temperatures higher than those employed to effect decomposition of the ion exchange group. In this way, decomposition gases generated during thermal decomposition are separated in two stages and gaseous nitrogen oxides ($NO_x$) and gaseous sulfur oxides ($SO_x$) which require a careful exhaust gas disposal treatment are generated only in the first stage low-temperature thermal decomposition; whereas hydrogen ($H_2$) gas, carbon monoxide (CO) gas, carbon dioxide ($CO_2$) gas and the like, which scarcely require any particular exhaust gas disposal treatment are generated in the second stage high-temperature thermal decomposition. According to this method, it is possible to reduce markedly the volume of exhaust gas which must be processed in a careful disposal treatment as compared with the case where the entire thermal decomposition is carried out at the same time and the entire exhaust gases are in the form of a mixture; the volume of the waste resin is reduced; and the residue can be converted into stable inorganic compounds.

DESCRIPTION OF THE PREFERRED EMBODIMENT

Now the process of this invention and experimental results leading thereto will be described.

A cation exchange resin has a polymer matrix comprising a copolymer of styrene

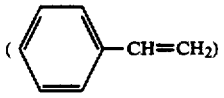

with divinylbenzene

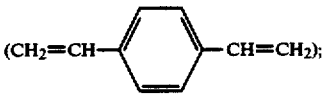

has a crosslinked structure formed by bonding a sulfonic acid group ($SO_3H$) as an ion exchange group to the polymer matrix; has a three-dimensional structure; and is represented by the following structural formula:

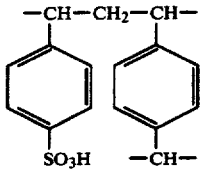

Further, its molecular formula is represented by $(C_{16}H_{15}O_3S)_n$.

On the other hand, an anion exchange resin is prepared by bonding a quaternary ammonium group ($NR_3OH$) as an ion exchange group to the same polymer matrix as in the cation exchange resin; and is represented by the following structural formula:

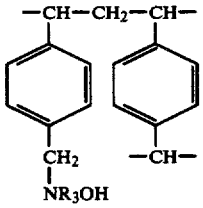

(R:$CH_3$)

Further, its molecular formula is represented by $(C_{20}H_{26}ON)_n$.

Figure 1:
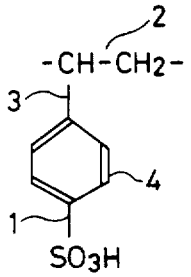
FIG. 1 is a skeletal structure of an ion exchange resin.

The bond energy of a bonding between the constituents of an ion exchange resin is illustrated. FIG. 1 shows a skeletal structure of a cation exchange resin, and the case of an anion exchange resin is basically the same except that the ion exchange group is different. Table 1 shows the bond energies of bondings 1, 2, 3 and 4 between the constituents in FIG. 1.

TABLE 1

| Bonding | | Structure | Bond energy* (kJ/mol) |
|---|---|---|---|
| 1 | Ion exchange groups | Quaternary ammonium group (anion exchange resin) | 246 |
| | | Sulfonic acid group (cation exchange resin) | 260 |
| 2, 3 | Polymer | Straight-chain moiety | 330–370 |

TABLE 1-continued

| Bonding | | Structure | Bond energy* (kJ/mol) |
|---|---|---|---|
| 4 | matrix | Benzene ring moiety | 480 |

*Bond energy values obtained from "Daiyukikagaku", Spec. Vol. 2, published by Asakura-shoten, 1963, Ed. by Munio Kotake When an ion exchange resin is thermally decomposed, the ion exchange group with the lowest bond energy is first decomposed, then the chain moiety of the polymer matrix is decomposed, and finally the benzene ring moiety is decomposed.

Figure 2:
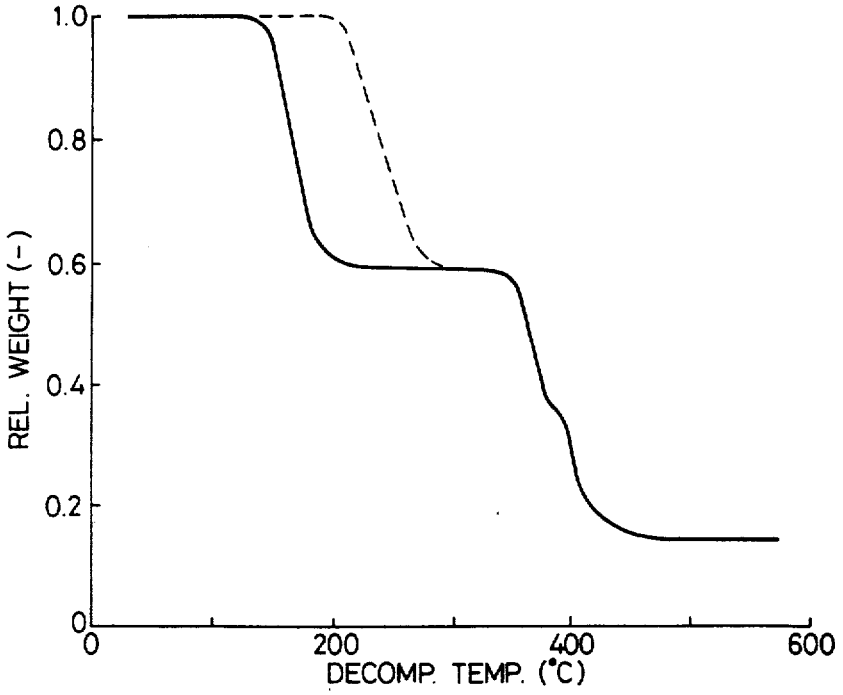
FIG. 2 is a graph showing the results of a thermogravimetric analysis of an ion exchange resin.

FIG. 2 shows the results of a thermogravimetric analysis (TGA) of an ion exchange resin using a differential calorimetric balance. In FIG. 2, weight loss due to the evaporation of water occuring at 70° to 110° C. is not shown. The solid line represents a thermal weight change of an anion exchange resin, and the broken line represents that of a cation exchange resin. Table 2 lists decomposition temperatures of the bondings shown in FIG. 2.

TABLE 2

| | Structure | Decomposition temperature (°C.) |
|---|---|---|
| Ion exchange groups | Quaternary ammonium group (anion exchange resin) | 130–190 |
| | Sulfonic acid group (cation exchange resin) | 200–300 |
| Polymer matrix | Straight chain moiety | 350–400 |
| | Benzene ring moiety | 380–480 |

According to Table 2, in case of an anion exchange resin, the quaternary ammonium group as an ion exchange group is first decomposed at 130° to 190° C., then the straight chain moiety at above 350° C., and the benzene ring moiety at above 380° C. In case of a cation exchange resin, the sulfonic acid group as an ion exchange group is decomposed at 200° to 300° C., and then the straight-chain and the benzene ring moieties are decomposed at the same temperatures required in the case of an anion exchange resin.

Based on the above results, only the ion exchange group of an ion exchange resin is selectively decomposed in the first stage by carrying out low-temperature thermal decomposition at 350° C. or below, and the nitrogen or sulfur contained only in the ion exchange group is converted in this stage into nitrogen compounds ($NO_x$, $NH_3$, etc.) or sulfides ($SO_x$, $H_2S$, etc.), which are then disposed of by conventional techniques. Then the residue is reduced to below a few %, e.g. 3 to 10% in the second stage by carrying out the high-temperature thermal decomposition at above 350° C. and completely decomposing the polymer matrix consisting of carbon and hydrogen. The exhaust gas generated in this stage consists of CO, $CO_2$, $H_2$, and the like and hence no particular exhaust gas disposal treatment is necessary. When an ion exchange resin is decomposed by dividing thermal decomposition into a plurality of stages including low-temperature and high-temperature thermal decomposition, the exhaust gas disposal can be markedly facilitated as compared with a case where the thermal decomposition is carried out in one stage at a high temperature of above 350° C., e.g. from 350° to 1000° C. Namely, when the thermal decomposition is carried out in one stage, 1.42 $m^3$ of exhaust gas is generated per kg of an ion exchange resin (a 2:1 mixture of cation exchange and anion exchange resins), and this gas contains only about 5% of sulfur oxides and nitrogen oxides (the sum of the both is 0.074 $m^3$). On the other hand, in case of the two-stage thermal decomposition, low-temperature thermal decomposition is first carried out at 300° C. or below and then the high-temperature thermal decomposition is carried out at above 350° C., so that 0.074 $m^3$ or sulfur oxides and nitrogen oxides are produced only in the first stage low-temperature thermal decomposition, and these gases are not produced in the second stage high-temperature thermal decomposition, though 1.34 $m^3$ of $CO_2$ and the like are produced. Because sulfur oxides and nitrogen oxides of which the discharge into the atmosphere is regulated and which require exhaust gas treatment such as desulfurization and denitrification are generated in small quantities only in the first stage low-temperature thermal decomposition, the volume of the exhaust gas to be treated extensively can be reduced to only 0.074 $m^3$. On the other hand, when the thermal decomposition is carried out in one stage, the exhaust gas in a quantity of as large as 1.42 $m^3$ must be disposed together with other various gases in order to dispose the above exhaust gases (sulfur oxides, nitrogen oxides) contained in a quantity of as low as 0.074 $m^3$ (5%), and this inevitably leads to the use of a large-scale exhaust gas disposal equipment. Namely, it becomes possible to reduce the volume of exhaust gas which requires a careful exhaust gas disposal treatment to about 1/20 by carrying out the two-stage thermal decomposition of this invention.

It is further possible to scavenge $SO_x$ which accounts for ⅔ of the exhaust gas generated during the low-temperature decomposition by adding a scavenger for sulfur oxides ($SO_x$) formed during the low-temperature thermal decomposition and to thereby reduce the volume of the exhaust gas requiring a careful treatment to about 0.025 $m^3$, i.e., 1/90 of the total volume of the exhaust gas. Transition metal oxides, such as manganese oxide ($MnO_2$) and nickel oxide (NiO), and calcium salts are effective as the scavenger. Calcium oxide (CaO) is preferred from the viewpoint of cost and performance, though mixtures of such oxides are also effective.

EXAMPLE 1

Figure 3:
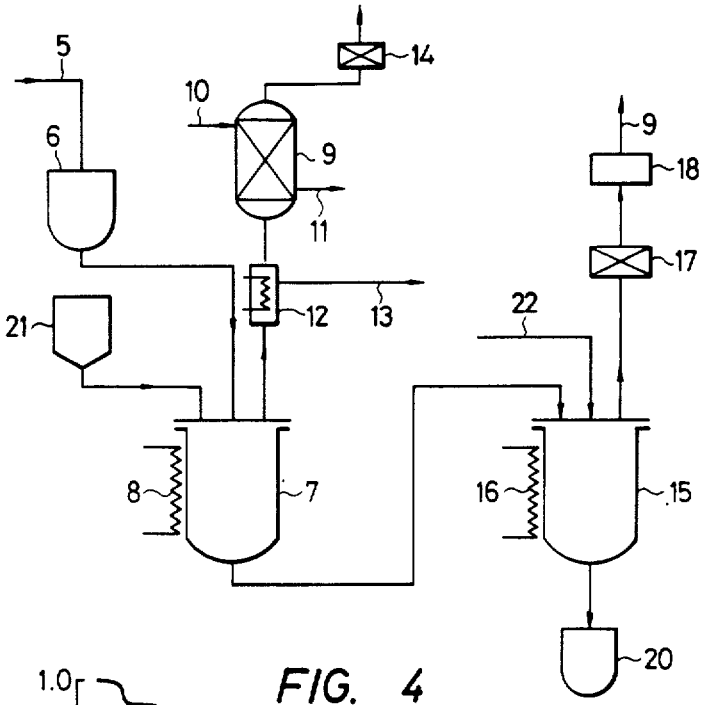
FIG. 3 is a flowsheet showing an example of this invention.

This invention will now be described in detail with reference to an example shown in FIG. 3. This example illustrates a volume reduction treatment comprising thermally decomposing an ion exchange resin discharged from a condensate demineralizer of a boiling water reactor. FIG. 3 shows an example of equipment for practicing this invention. The waste resin is in the form of slurry in order to discharge it from the condensate demineralizer by back-washing. The waste resin slurry is fed to a slurry tank 6 through a sluury transfer conduit 5. A predetermined amount of the waste resin in the slurry tank 6 is fed to a reaction vessel 7, heated to 350° C. by a heater 8 in an inert gas atmosphere (for example, nitrogen gas) to effect thermal decomposition of the waste resin. By this thermal decomposition, only the ion exchange group undergoes decomposition, and sulfur oxides ($SO_x$), sulfur compounds ($H_2S$, etc.), nitrogen oxides ($NO_x$), nitrogen compounds ($NH_3$, etc.) are generated in the gaseous form. These exhaust gases are scrubbed in an alkali scrubber 9 with an aqueous sodium hydroxide solution 10 and converted into an aqueous solution of the sodium salt 11. These compounds can be disposed by a chemical waste disposal unit in the area of an atomic power plant. Further, the moisture contained in the waste resin is generated in the form of steam, which is condensed in a condenser 12 and serves as recirculation water 13. The exhaust gas treated in the alkali scrubber 9 (consisting mainly of inert gas) is passed through a filter 14 and then discharged. The waste resin (only the polymer matrix) which has undergone the low-temperature thermal decomposition in the reaction vessel 8 is transferred to a reaction vessel 15 and heated to above 350° C., i.e. 600° C., by a heater 16 to effect thermal decomposition. By this high-temperature thermal decomposition of the waste resin the undecomposed polymer matrix undergoes decomposition and forms a stable inorganic residue, which is a substance extremely stable to storage and keeping. By this decomposition, carbon dioxide ($CO_2$), carbon monoxide (CO), hydrogen ($H_2$) and hydrocarbons ($CH_4$, etc.) are formed. These gases are passed through a filter 17, burned in a flare stack 18, and discharged in the form of gas 19 such as $CO_2$ or steam ($H_2O$). The residue after the decomposition consists mainly of silica ($SiO_2$) or a crud (consisting mainly of iron oxides). And the radioactive components are contained in the residue as a oxides or sulfides.

And the residue is stored in a tank 20. This is placed in a drum or the like and finally solidified with a solidifying agent such as cement or plastic.

In carrying out decomposition in the reaction vessel 7, air can also be used as an atmosphere without any obstruction instead of inert gas.

In FIG. 3, it is also possible that CaO as an $SO_x$ scavenger is added from a tank 21 to convert the formed $SO_x$ into $CaSO_4$, which is then incorporated in the decomposition residue. In this case, the volume of the exhaust gas is reduced but the amount of the residue is somewhat increased.

Further in carrying out decomposition in the reaction vessel 15, it is preferred to add an oxidizing agent 22 such as steam, air or oxygen gas for the purpose of improving the rate of decomposition.

Figure 4:
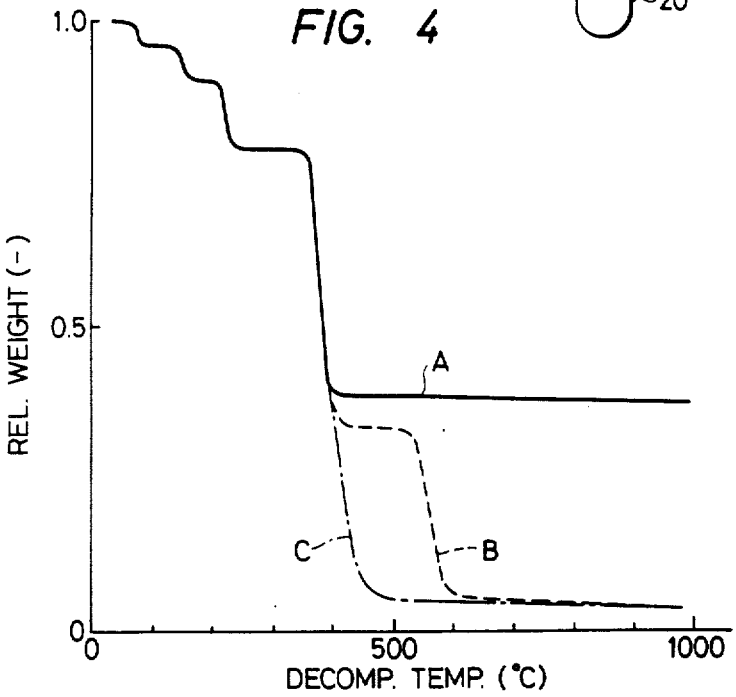
FIG. 4 is a graph showing the thermal decomposition characteristics of an ion exchange resin.

FIG. 4 illustrates the effect of the addition of an oxidizing agent. In the graph, about 25 to 30% of a residue is left even when the waste resin is heated to 1,000° C. in case of a nitrogen atmosphere to which no oxidizing is added in the high-temperature thermal decomposition which is effected at above 350° C. (represented by curve A). On the other hand, when steam is added as an oxidizing agent (represented by curve B), the amount of the residue is greatly reduced at above 600° C., and reduced to below several % at above 700° C. Further, when air is used as an oxidizing agent (represented by curve C), the weight is greatly reduced at above 400° C. and the residue is reduced to several % at above 500° C. Namely, when the high-temperature decomposition is carried out in the reaction vessel 15, it is preferred to carry out the decomposition at above 700° C. in case of an inert gas atmosphere such as nitrogen gas, and at above 500° C. in case of an air atmosphere. To minimize the amount of the residue, it is preferred to add an oxidizing agent such as steam or air. By this, it becomes possible to reduce the volume of the waste resin to 1/10. Oxygen gas is not preferred as an oxidizing agent because of a hazard of explosion.

Although the low-temperature and the high-temperature thermal decompositions in this example are carried out in separate reaction vessels, it is also possible to carry out both decompositions in the same reaction vessel. Namely, the same effect as in the above example can be obtained by raising the temperature stepwise in two stages in the same reactor and switching the exhaust gas disposal equipment.

Although this example is one of application to a boiling water reactor, this invention is also applicable to waste resins produced from the waste liquor purification system of radioactive substance handling equipment, such as a reactor purification system, or a primary coolant purification system of a pressurized water reactor.

EXAMPLE 2

1 kg of an ion exchange resin containing adsorbed cobalt-60 was placed in a 20 l Inconel type reaction vessel and heated to subject it to the first stage low-temperature thermal decomposition at 350° C. for 2 hours. Then, steam was added at a flow rate of 0.01 $Nm^3$/hour, and the waste resin was subjected to the second stage high-temperature thermal decomposition at 800° C. As a result, about 30 g of ash was left as a residue in the reaction vessel. The exhaust gas generated in the first stage was passed through both a gas scrubbing bottle charged with 5 l of a 1 wt. % aqueous NaOH solution and high-performance filter, whereby the concentrations of $SO_x$ and $NO_x$ in the exhaust gas were each reduced to below 0.1 ppm and a decontamination factor of above 1,000 was obtained. Further, the exhaust gas generated in the second stage was passed through a ceramic filter and an HEPA filter, thereby giving a decontamination factor of about 1,000.

When the waste resin contains adsorbed easily volatile radioactive substances such as cesium-137 or cesium-134 in carrying out the second stage high-temperature thermal decomposition in the twostage thermal decomposition as shown in Example 1, it is preferred to prevent the volatilization of the radioactive substances by adding a vitrifying material and fixing them within the network structure of glass. The vitrifying material can be glass frit consisting mainly of silica ($SiO_2$) which is a usual glass component, and it is preferred to add about 20 wt. % of boron oxide ($B_2O_3$) in order to carry out effectively the melting and solidification of glass during the thermal decomposition.

EXAMPLE 3

1 kg of an ion exchange resin containing adsorbed cesium-137 was subjected to thermal decomposition in the same manner and the same conditions as in Example 2. In carrying out the second stage high-temperature thermal decomposition, 30 g of glass frit and 6 g of $B_2O_3$ were added. The proportion of cesium-137 contained in the waste gas produced in the second stage was about 1% of that contained in the initial resin. Namely, 99% of cesium-137 was fixed in a residue (about 60 g).

In the two-stage thermal decomposition in Example 1, it is also possible that the reaction residue after the first stage low-temperature thermal decomposition is ground, if necessary, to a desired particle size and the ground reaction residue is burned with diffusion flame to effect the high-temperature thermal decomposition. This method makes the exhaust gas disposal easier than with a method in which the residue is directly burned at once, because the exhaust gas contains no $SO_x$ and $NO_x$. It is also possible to recover the heat of combustion during burning and utilize it as a heat source for the first stage low-temperature thermal decomposition. This improves the thermal efficiency.

What is claimed is:

1. A method for processing spent radioactive ion exchange resin formed in a nuclear power plant comprising the steps of:

(a) heating the spent ion exchange resin to thermally decompose the ion exchange groups of said ion exchange resin at low temperatures of not more than 350° C. to form exhaust gas containing decomposition products of said ion exchange groups and a residue containing the polymer matrix of said ion exchange resin; and then (b) heating the residue to thermally decompose the polymer matrix of said ion exchange resin at high temperatures above 350° C. to form exhaust gas containing decomposition products of said polymer matrix and a residue containing radioactive components.

2. A method of processing spent radioactive ion exchange resin according to claim 1, wherein the exhaust gas formed from the thermal decomposition of the ion exchange groups of said ion exchange resin are separated from said residue and are treated in an alkali scrubber.

3. A method for processing spent radioactive ion exchange resin according to claim 1, wherein said thermal decomposition at high temperatures is carried out in the presence of an oxidizing agent.

4. A method for processing spent radioactive ion exchange resin according to claim 3, wherein said thermal decomposition at low temperatures is carried out in the presence of a scavenger for sulfur compounds.

5. A method for processing spent radioactive ion exchange resin according to claim 4, wherein said scavenger comprises a transition metal oxide, a calcium compound or a mixture thereof.

6. A method for processing spent radioactive ion exchange resin according to claim 4, wherein said thermal decomposition at high temperatures is carried out in the presence of a vitrifying material which can adsorb volatile radioactive substances.

7. A method for processing spent radioactive ion exchange resin according to claim 6, wherein said vitrifying material comprises glass frit consisting mainly of silica.

8. A method for processing spent radioactive ion exchange resin according to claim 1, wherein said thermal decomposition at high temperatures consists in burning the ion exchange resin using a gas containing combustible gas.

9. A method for processing spent radioactive ion exchange resin according to claim 1, wherein said thermal decomposition at low temperatures is carried out in the presence of a scavenger for sulfur compounds.

10. A method for processing spent radioactive ion exchange resin according to claim 9, wherein said scavenger comprises a transition metal oxide, a calcium compound or a mixture thereof.

11. A method for processing spent radioactive ion exchange resin according to claim 8, wherein said thermal decomposition at low temperatures is carried out in the presence of a scavenger for sulfur compounds.

12. A method for processing spent radioactive ion exchange resin according to claim 11, wherein said scavenger comprises a transition metal oxide, a calcium compound or a mixture thereof.

13. A method for processing spent radioactive ion exchange resin according to claim 3, wherein said thermal decomposition at high temperatures is carried out in the presence of a vitrifying material which can adsorb volatile radioactive substances.

14. A method for processing spent radioactive ion exchange resin according to claim 13, wherein said vitrifying material comprises glass frit consisting mainly of silica.

15. A method for processing spent radioactive ion exchange resin according to claim 1, wherein said thermal decomposition at high temperatures is carried out in the presence of a vitrifying material which can adsorb volatile radioactive substances.

16. A method for processing spent radioactive ion exchange resin according to claim 15, wherein said vitrifying material comprises glass frit consisting mainly of silica.

* * * * *